US007591131B2

(12) United States Patent
Easley, Jr. et al.

(10) Patent No.: US 7,591,131 B2
(45) Date of Patent: Sep. 22, 2009

(54) LOW PRESSURE EGR SYSTEM HAVING FULL RANGE CAPABILITY

(75) Inventors: William Lanier Easley, Jr., West Peoria, IL (US); David Michael Milam, Dunlap, IL (US); Stephan Donald Roozenboom, Washington, IL (US); Michael Steven Bond, Chillicothe, IL (US); Amir Kapic, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 299 days.

(21) Appl. No.: 11/606,332

(22) Filed: Nov. 30, 2006

(65) Prior Publication Data

US 2008/0127645 A1 Jun. 5, 2008

(51) Int. Cl.
*F02M 25/06* (2006.01)

(52) U.S. Cl. ..... 60/278; 60/274; 60/280; 60/285; 60/295; 60/297; 60/301; 60/605.1; 60/605.2

(58) Field of Classification Search ..... 60/274, 60/278, 280, 285, 295, 297, 301, 311, 605.1, 60/605.2

See application file for complete search history.

(56) References Cited

U.S. PATENT DOCUMENTS

| | | | | |
|---|---|---|---|---|
| 6,301,887 | B1 * | 10/2001 | Gorel et al. | 60/605.2 |
| 6,742,335 | B2 | 6/2004 | Beck et al. | |
| 6,948,475 | B1 | 9/2005 | Wong et al. | |
| 7,017,560 | B2 * | 3/2006 | Eriksson et al. | 123/568.12 |
| 7,043,914 | B2 | 5/2006 | Ishikawa | |
| 7,189,374 | B1 * | 3/2007 | Hawker | 422/168 |
| 7,207,311 | B2 * | 4/2007 | Chmela et al. | 123/305 |
| 2006/0021328 | A1 | 2/2006 | Leweux et al. | |
| 2006/0124116 | A1 | 6/2006 | Bui | |
| 2006/0156724 | A1 | 7/2006 | Dismon et al. | |

FOREIGN PATENT DOCUMENTS

| | | | | |
|---|---|---|---|---|
| DE | 198 53 119 | A1 | 5/1999 | |
| DE | 10 2005 008 638 | A1 | 8/2006 | |
| EP | 1 072 764 | A1 | 1/2001 | |
| JP | 2002276405 | A * | 9/2002 | 60/278 |
| WO | WO 2006/086419 | A1 | 8/2006 | |

OTHER PUBLICATIONS

PCT International Search Report; Applicant's File Ref.: 06-569; PCT/US2007/018189; International Filing Date: Aug. 16, 2007; Applicant: Caterpillar Inc.

* cited by examiner

*Primary Examiner*—Binh Q. Tran
(74) *Attorney, Agent, or Firm*—Finnegan, Henderson, Farabow, Garrett & Dunner

(57) ABSTRACT

An exhaust treatment system for an engine is disclosed and may have an air induction circuit, an exhaust circuit, and an exhaust recirculation circuit. The air induction circuit may be configured to direct air into the engine. The exhaust circuit may be configured to direct exhaust from the engine and include a turbine driven by the exhaust, a particulate filter disposed in series with and downstream of the turbine, and a catalytic device disposed in series with and downstream of the particulate filter. The exhaust recirculation circuit may be configured to selectively redirect at least some of the exhaust from between the particulate filter and the catalytic device to the air induction circuit. The catalytic device is selected to create backpressure within the exhaust circuit sufficient to ensure that, under normal engine operating conditions above low idle, exhaust can flow into the air induction circuit without throttling of the air.

20 Claims, 1 Drawing Sheet

LOW PRESSURE EGR SYSTEM HAVING FULL RANGE CAPABILITY

This invention was made with Government support under DOE Contract No. DE-FC05-00OR22806 awarded by the U.S. Department of Energy. Accordingly, the Government may have certain rights to this invention.

TECHNICAL FIELD

The present disclosure relates generally to an exhaust gas recirculation (EGR) system and, more particularly, to a low pressure exhaust gas recirculation system operable to recirculate exhaust gas back into an engine under a full range of conditions without throttling of intake air.

BACKGROUND

Internal combustion engines such as gasoline engines, diesel engines, and gaseous fuel-powered engines exhaust a complex mixture of air pollutants. These air pollutants are composed of solid particulate matter and gaseous compounds including nitrous oxides (NOx). Due to increased attention on the environment, exhaust emission standards have become more stringent and the amount of solid particulate matter and gaseous compounds emitted to the atmosphere from an engine is regulated depending on the type of engine, size of engine, and/or class of engine.

One method that has been implemented by engine manufacturers to comply with the regulation of these engine emissions has been to implement exhaust gas recirculation (EGR). EGR systems recirculate the exhaust gas by-products into the intake air supply of the internal combustion engine. The exhaust gas, which is redirected to a cylinder of the engine, reduces the concentration of oxygen therein, thereby increasing the heat capacity of the mixture and lowering the maximum combustion temperature within the cylinder. The lowered maximum combustion temperature and reduced oxygen slow the chemical reactions responsible for the formation of NOx, thereby reducing the amount of NOx emitted by the engine. In addition, the particulate matter entrained in the exhaust is burned upon reintroduction into the engine cylinder to further reduce the exhaust gas by-products.

One available type of EGR system is called a low pressure system. Low pressure EGR systems draw low pressure exhaust from downstream of an engine's turbine and direct the exhaust to a location upstream of the engine's compressor. An example of a low pressure EGR system was disclosed in U.S. Pat. Publication No. 2006/0156724 (the '724 publication) by Dismon et al. on Jul. 20, 2006. Specifically, the '724 publication disclosed an exhaust gas return system having a particulate trap located in series with and downstream of a turbine. The exhaust gas return system also has a catalyst located in series with and downstream of the particulate trap. Exhaust gas is drawn from a location between the particulate filter and the catalyst for return to an air inlet passageway upstream of a compressor. An exhaust gas return valve is disposed within an exhaust gas line between the particulate filter and the catalyst to control the flow rate of returned exhaust gases.

Although the low pressure exhaust gas return system of the '724 publication may reduce the amount of NOx and particulate matter exhausted to the atmosphere, it may be limited. In particular, there may be some situations where the pressure differential between the exhaust and intake air is insufficient for proper operation. In other words, it is possible for the pressure of the recirculated exhaust to be substantially the same as or even lower than the pressure of the intake air. In these situations, the exhaust will flow poorly or not at all into the air inlet passageway. Without sufficient return of the exhaust, the engine's emissions may fail to be compliant with the environmental regulations.

Further, the disclosed placement of the exhaust gas return valve may be problematic. Specifically, because this valve is located within the exhaust gas line, the temperatures experienced by the valve may be excessive. These high temperatures may degrade the valve over time, possibly resulting in premature failure of the valve.

The disclosed EGR system is directed to overcoming one or more of the problems set forth above.

SUMMARY OF THE INVENTION

In one aspect, the present disclosure is directed to an exhaust treatment system for an engine. The exhaust treatment system may include an air induction circuit, an exhaust circuit, and an exhaust gas recirculation circuit. The air induction circuit may be configured to direct air into the engine. The exhaust circuit may be configured to direct exhaust from the engine and include a turbine driven by the exhaust, a particulate filter disposed in series with and located downstream of the turbine, and a catalytic device disposed in series with and located downstream of the particulate filter. The exhaust gas recirculation circuit may be configured to selectively redirect at least a portion of the exhaust from between the particulate filter and the catalytic device to the air induction circuit. The catalytic device is selected to create a backpressure within the exhaust circuit sufficient to ensure that, under normal engine operating conditions above low idle, exhaust can flow into the air induction circuit without throttling of the air directed into the engine.

In another aspect, the present disclosure is directed to a method of producing power. The method may include mixing intake air with fuel, and combusting the mixture to generate power and a flow of exhaust. The method may also include utilizing the exhaust to compress the intake air, and removing particulate matter from the exhaust. The method may also include catalyzing the exhaust to reduce a constituent of the exhaust, and redirecting the particulate-reduced exhaust to mix with the intake air. The step of catalyzing creates a backpressure within the exhaust sufficient to ensure that, under normal combustion conditions above low idle, the exhaust can be redirected to mix with the intake air without throttling of the intake air.

DETAILED DESCRIPTION

Figure 1:
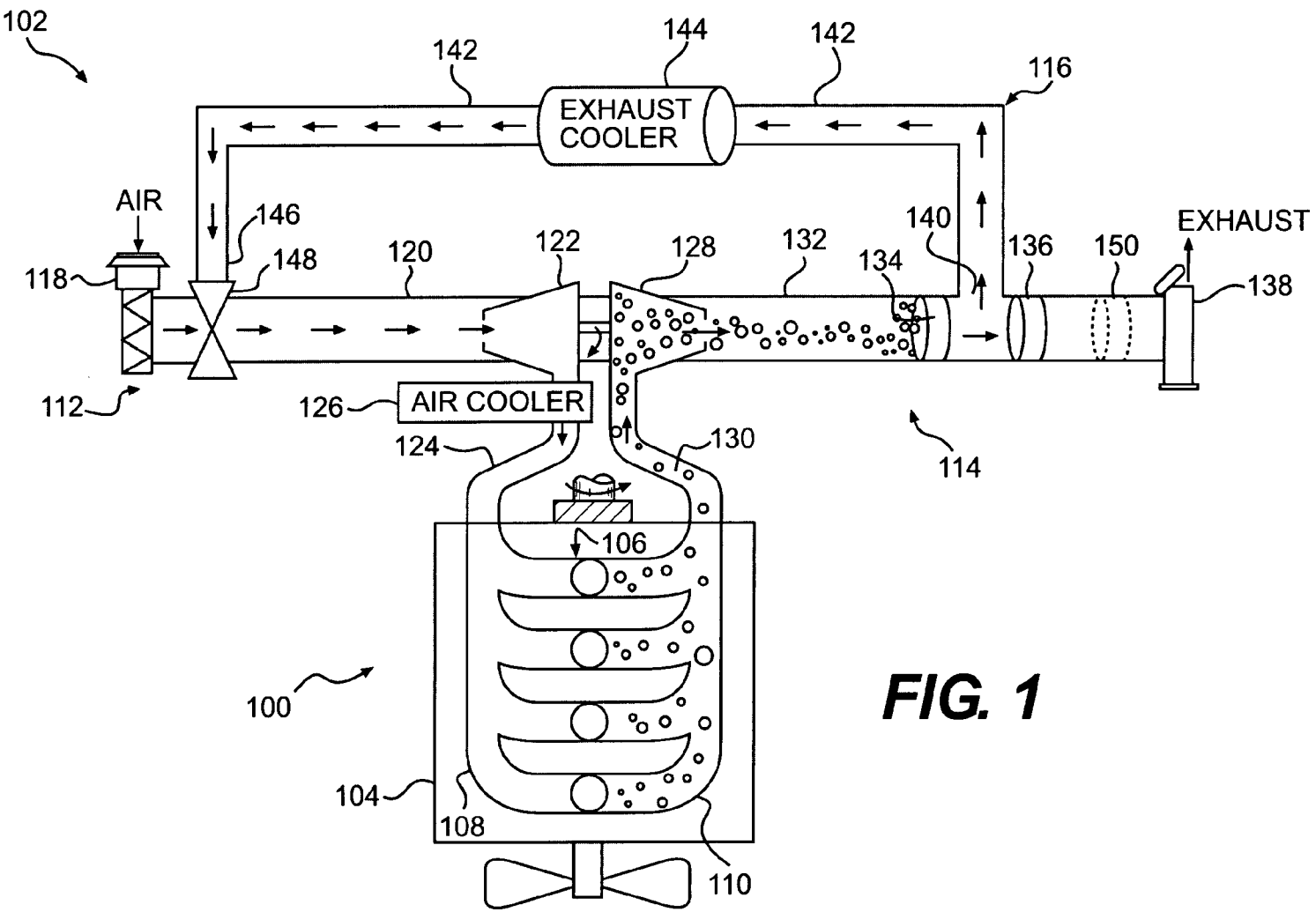
FIG. 1 is a diagrammatic illustration of an exemplary disclosed power unit.

FIG. 1 illustrates a power unit 100 having an exhaust treatment system 102. For the purposes of this disclosure, power unit 100 is depicted and described as a four-stroke diesel engine. One skilled in the art will recognize, however, that power unit 100 may be any other type of internal combustion engine such as, for example, a gasoline engine or a gaseous fuel-powered engine. Further, power unit 100 may be any other type of power and exhaust producing device such as, for example, or a furnace. Generally, power unit 100 may combust a fuel/air mixture to generate power and exhaust, and direct that exhaust to exhaust treatment system 102. Exhaust treatment system 102 may receive the exhaust, treat the exhaust, and direct the exhaust into the atmosphere.

Power unit 100 may include an engine block 104 that at least partially defines a plurality of combustion chambers 106 in fluid communication with both an intake manifold 108 and an exhaust manifold 110. In the illustrated embodiment, power unit 100 includes four combustion chambers 106. However, it is contemplated that power unit 100 may include a greater or lesser number of combustion chambers 106 and that combustion chambers 106 may be disposed in an "in-line" configuration, a "V" configuration, or any other suitable configuration.

Power unit 100 may compress a mixture of fuel and air, which is then controllably combusted to produce a power output and exhaust. Each combustion chamber 106 may receive fuel and air, house the combustion of the fuel and air, and direct exhaust resulting from the combustion process to exhaust manifold 110. The exhaust may contain carbon monoxide, oxides of nitrogen, carbon dioxide, aldehydes, soot, oxygen, nitrogen, water vapor, and/or hydrocarbons such as hydrogen and methane. One skilled in the art will recognize that power unit 100 may include a plurality of other components such as a fuel tank, one or more fuel injectors, various control valves, a pre-combustion chamber, or other components consistent with the process of generating power and exhaust.

Intake manifold 108 may have one or more inlet ports, and direct air or a mixture of air and other gases from a passageway in fluid communication with the inlet ports to combustion chambers 106. Similarly, exhaust manifold 110 may have one or more outlet ports, and direct exhaust from combustion chambers 106 to a passageway in fluid communication with the outlet ports. It is contemplated that power unit 100 may contain a plurality of intake and/or exhaust manifolds to direct air and exhaust to and from combustion chambers 106, respectively.

Exhaust treatment system 102 may include an air induction circuit 112, an exhaust circuit 114, and an exhaust gas recirculation (EGR) circuit 116. Air induction circuit 112 may draw air or a mixture of air and other gases into power unit 100 for combustion, which may produce power and exhaust. Exhaust circuit 114 may direct a portion of the exhaust from power unit 100 to the atmosphere, while EGR circuit 116 may recirculate the remaining portion of the exhaust from exhaust circuit 114 to air induction circuit 112.

Air induction circuit 112 may include components that introduce charged air into combustion chambers 106 of power unit 100. For example, air induction circuit 112 may include an air inlet port 118, an intake passageway 120, a compressor 122, an intake fluid conduit 124, and an air cooler 126. It is contemplated that additional and/or different components may be included within air induction circuit 112 such as, for example, a wastegate, a bypass system, a control system, and other means known in the art for introducing charged air into combustion chambers 106.

Air inlet port 118 may fluidly communicate with intake passageway 120, and may be associated with an air cleaner to clean the air entering air induction circuit 112. Intake passageway 120 may also fluidly communicate compressor 122 with air inlet port 118.

Compressor 122 may be fluidly connected to the one or more inlet ports of intake manifold 108 via intake fluid conduit 124 to compress the air flowing into power unit 100. Compressor 122 may embody a fixed geometry compressor, a variable geometry compressor, or any other type of compressor known in the art. It is contemplated that multiple compressors 122 may alternatively be included within air induction circuit 112 and disposed in a series or parallel relationship. It is further contemplated, however, that compressor 122 may be absent, if a naturally-aspirated engine is desired.

Air cooler 126 may facilitate the transfer of heat to or from the air compressed by compressor 122, prior to the compressed air entering intake manifold 108. For example, air cooler 126 may embody an air-to-air heat exchanger or a liquid-to-air heat exchanger. Air cooler 126 may include a tube and shell type heat exchanger, a plate type heat exchanger, or any other type of heat exchanger known in the art. In the embodiment exemplified by FIG. 1, air cooler 126 is disposed downstream of compressor 122 and upstream of intake manifold 108. However air cooler 126 may alternatively be located upstream of compressor 122, if desired.

Exhaust circuit 114 may include components that treat and fluidly direct the exhaust from combustion chambers 106. For example, exhaust circuit 114 may include a turbine 128, an exhaust fluid conduit 130, an exhaust passageway 132, a particulate filter 134, a catalytic device 136, and an exhaust port 138. It is contemplated that exhaust circuit 114 may include additional and/or different components than those recited above such as, for example, one or more additional catalytic devices 150 disposed in a series or parallel relationship with catalytic device 136, or any other exhaust circuit component known in the art.

Turbine 128 may receive the exhaust from combustion chambers 106 via exhaust fluid conduit 130, which may be in fluid communication with the one or more outlets of exhaust manifold 110. Turbine 128 may be connected to drive compressor 122, with turbine 128 and compressor 122, together, embodying a turbocharger. In particular, as the hot exhaust gases exiting power unit 100 expand against the blades (not shown) of turbine 128, turbine 128 may rotate and drive compressor 122. It is contemplated that more than one turbine 128 may alternatively be included within exhaust circuit 114 and disposed in a parallel or series relationship, if desired. The one or more turbines 128 may further be arranged in a turbocompounding configuration wherein at least one turbine is coupled with power unit 100 such that power produced by the turbine is returned to power unit 100. For example, a turbine may be disposed in a series relationship with turbine 128 and mechanically, hydraulically, or electrically linked to the crankshaft (not shown) of power unit 100. It is also contemplated that turbine 128 may be omitted and compressor 122 driven by power unit 100 mechanically, hydraulically, electrically, or in any other manner known in the art, if desired.

After exiting turbine 128, the exhaust may be fluidly directed through exhaust passageway 132. Particulate filter 134 may be disposed within exhaust passageway 132 downstream of turbine 128. As exhaust from power unit 100 flows through exhaust passageway 132, particulate filter 134 may remove particulate matter from the exhaust flow. Particulate filter 134 may include, among other things, a wire mesh or ceramic honeycomb filtration medium, or a wall-flow style filter.

Catalytic device 136 may also be disposed within exhaust passageway 132, downstream of particulate filter 134. Catalytic device 136 may include one or more substrates coated with or otherwise containing a liquid or gaseous catalyst such as, for example, a precious metal-containing washcoat. The catalyst may be utilized to reduce the by-products of combustion in the exhaust flow by means of, for example, selective catalytic reduction or NOx trapping. In one example, a reagent urea may be injected into the exhaust flow upstream of catalytic device 136. The reagent may decompose to ammonia, which may react with the NOx in the exhaust gas across the catalyst to form H2O and N2. In another example, NOx in the exhaust gas may be trapped by a NOx trap, such as a barium salt NOx trap, and periodically be released and reduced across the catalyst to form CO2 and N2. Catalytic device 136 may also oxidize particulate matter that remains in the exhaust flow after passing through particulate filter 134.

The size, thickness, and/or other parameters of catalytic device 136 may be chosen such that the backpressure produced from running the exhaust gas through it during operation of power unit 100 is sufficient to always drive some amount of the exhaust gas into EGR circuit 116. For example, the minimum backpressure created by catalytic device 136 may be at least 1 kPa during normal operating conditions of power unit 100 above low idle. However, the size of catalytic device 136 may be preferably chosen such that the backpressure ranges from 10-30 kPa during rated power unit 100 operation. In a most-preferred embodiment, the size of catalytic device 136 may be chosen such that the backpressure ranges from 10-15 kPa during rated operation of power unit 100. Normal operating conditions above low idle may include engine speeds ranging from above 700 rpm to about 2300 rpm. Rated operation of power unit 100 may be one or more conditions at which the manufacturer of power unit 100 guarantees a particular performance, and at which power unit 100 is designed to run most of the time and run optimally. This may correspond with one or more speeds and/or one or more torque outputs. For example, power unit 100 may have a rated operating speed of about 1800 rpm. Thus, the size of catalytic device 136 may be chosen such that the backpressure is at least 1 kPa when power unit 100 operates at greater than 700 rpm, and ranges from 10-15 kPa when power unit 100 operates at 1800 rpm.

Several environmental or contextual factors may affect the exact parameters of catalytic device 136 necessary to create the desired backpressure. These factors may include, without limitation, the operating temperature of power unit 100 and/or the ambient, the elevation of power unit 100 above sea level, the size of power unit 100, the rated operation of power unit 100, and the application of power unit 100. The parameters of catalytic device 136 may further be dependent upon the components of EGR circuit 116. For example, the length of the circuit and the size of the components included in the circuit may define a pressure drop in fluids that pass through the circuit. The value of the pressure drop may affect the desired backpressure created by catalytic device 136, and thus the parameters of catalytic device 136 necessary to create the desired backpressure. In some situations, it may be necessary to place multiple catalytic devices 136, 150 in series to create this desired backpressure. The treated exhaust may then be fluidly directed through exhaust port 138 into the atmosphere.

EGR circuit 116 may redirect a portion of the exhaust flow of power unit 100 from exhaust circuit 114 into air induction circuit 112. For example, EGR circuit 116 may include an EGR inlet port 140, an EGR passageway 142, an exhaust cooler 144, an EGR outlet port 146, and a mixing valve 148. It is contemplated that EGR circuit 116 may include additional and/or different components such as a catalyst, an electrostatic precipitation device, a shield gas system, a particulate trap, and other means known in the art for redirecting exhaust from exhaust circuit 114 into air induction circuit 112.

EGR inlet port 140 may be connected to exhaust circuit 114 to receive at least a portion of the exhaust flow from power unit 100. Specifically, EGR inlet port 140 may be disposed downstream of turbine 128 to receive low pressure exhaust gas from turbine 128. In the embodiment of FIG. 1, EGR inlet port 140 may also be located downstream of particulate filter 134, but upstream of catalytic device 136. It is contemplated that EGR inlet port 140 may alternatively be located upstream of particulate filter 134 to receive higher pressure exhaust if desired. However, in this configuration, a separate particulate trap within EGR passageway 142 may be required to reduce particulate matter in the recirculated exhaust.

EGR passageway 142 may fluidly connect EGR inlet port 140 to EGR outlet port 146. Exhaust cooler 144 may be disposed within EGR passageway 142 to cool the portion of the exhaust flowing through EGR inlet port 140. Exhaust cooler 144 may include, for example, a liquid-to-air heat exchanger, an air-to-air heat exchanger, or any other type of heat exchanger known in the art for cooling an exhaust flow. It is contemplated that exhaust cooler 144 may be omitted, if desired.

EGR outlet port 146 may be fluidly connected to mixing valve 148 to direct the exhaust flow from EGR passageway 142 through mixing valve 148 into intake passageway 120. Mixing valve 148 may be fluidly connected to both EGR outlet port 146 and air induction circuit 112 to regulate the flow of exhaust from EGR circuit 116 and air from air inlet port 118, respectively. Mixing valve 148 may include, for example, a butterfly valve element, a spool valve element, a check valve element, a gate valve element, a ball valve element, a globe valve element, or any other valve element known in the art. The valve element of mixing valve 148 may be movable between a flow-passing position and a flow-restricting position. The position of the valve element of mixing valve 148 between the flow-passing and flow-restricting positions may, at least in part, affect the amount of exhaust gas recirculated back into power unit 100. More specifically, mixing valve 148 may selectively allow, block, or partially block the flow of exhaust from EGR passageway 142 into intake passageway 120, thereby adjusting the air-to-exhaust ratio of gases passed into intake manifold 108. Mixing valve 148 may be disposed within intake passageway 120 upstream of compressor 122, so that the exhaust from EGR circuit 116 may be mixed with the air before the flow passes through compressor 122 and air cooler 126.

INDUSTRIAL APPLICABILITY

The disclosed EGR system may be applicable to any engine where emission control is desired. The disclosed EGR system may embody a low pressure system that recirculates a portion of the exhaust from an engine back into the combustion chambers of the engine under normal engine operating conditions above low idle without throttling the intake air. The recirculated portion of the exhaust may create a lean burn condition that reduces NOx and particulate matter. The operation of power unit 100 will now be explained.

Atmospheric air may be drawn into air induction circuit 112 through air inlet port 118, further passing through mixing valve 148, and intake passageway 120. The air may be mixed with recirculated exhaust at mixing valve 148 and may be directed through compressor 122 where it may be pressurized before entering intake manifold 108 of power unit 100. The mixture may further pass through air cooler 126 prior to entering intake fluid conduit 124, lowering the temperature of the air/exhaust mixture before it is combusted.

The cooled, pressurized, air/exhaust mixture may then be directed through intake manifold 108 to combustion chambers 106. Fuel may be mixed with the cooled, pressurized, air before or after entering combustion chambers 106, and combusted by power unit 100 to produce mechanical work output and a hot high-pressure exhaust flow containing gaseous compounds and solid particulate matter. The hot high-pressure exhaust flow may then be directed to turbine 128 via exhaust manifold 110 and exhaust fluid conduit 130. As the exhaust enters turbine 128, the expansion of hot exhaust gases may cause turbine 128 to rotate, thereby rotating connected compressor 122. The rotation of turbine 128 may cause compressor 122 to rotate and compress the air/exhaust mixture in air induction circuit 112, thereby facilitating movement of the mixture towards power unit 100 for subsequent combustion.

The work performed by the expansion of the exhaust gases on turbine 128 may reduce the pressure of the exhaust. More specifically, the exhaust downstream of turbine 128 may have a lower pressure than the exhaust upstream of turbine 128. This lower-pressure exhaust flow may then be directed along exhaust passageway 132 to particulate filter 134. Particulate filter 134 may remove some amount of the solid particulate matter from the exhaust flow. Substantially immediately after exiting particulate filter 134, the exhaust gas flow may be divided into two flows, including a first flow directed to EGR circuit 116 and a second flow directed through catalytic device 136 to the atmosphere, catalytic device 136 serving to reduce the amount of NOx and/or further reduce particulate matter exhausted to the atmosphere. It is contemplated that the two flows of exhaust gas may alternatively be divided upstream of particulate filter 134, if desired.

The exhaust gas may be driven through EGR inlet port 140, at least in part, by the backpressure created by catalytic device 136. Specifically, by choosing the parameters of catalytic device 136 appropriately with respect to the operational conditions of power unit 100, a minimum backpressure of 1 kPa may be created by catalytic device 136 under normal power unit 100 operating conditions above low idle. In preferred embodiments of the present disclosure, the size of catalytic device 136 may be chosen to create a backpressure of 10-15 kPa during rated operation of power unit 100. The backpressure may be sufficient to ensure that the exhaust gas is driven through EGR inlet port 140 without throttling the intake air.

As the first exhaust flow moves through EGR inlet port 140, it may be directed to exhaust cooler 144. The first exhaust flow may be cooled by exhaust cooler 144 to a predetermined temperature, which may further reduce the pressure of the exhaust gases in the first exhaust flow. The first exhaust flow may then be drawn through EGR outlet port 146 and mixing valve 148 back into air induction circuit 112 by compressor 122. The recirculated exhaust flow may then be mixed with the air entering combustion chambers 106 for subsequent combustion.

The exhaust gas that is mixed with air and directed to combustion chambers 106 may reduce the concentration of oxygen therein, which in turn may increase the heat capacity of the mixture and lower the maximum combustion temperature within power unit 100. The lowered maximum combustion temperature and reduced oxygen may slow the chemical reactions responsible for the formation of nitrous oxides, thereby reducing the amount of NOx emitted by power unit 100.

The present disclosure may provide an EGR system and method of recirculating exhaust gas that, by directing the exhaust gas into EGR circuit 116 from upstream of a specifically sized catalytic device, guarantees the exhaust gas will be driven by pressure sufficient to ensure proper mixing of the recirculated exhaust gas and air under normal operating conditions above low idle. This guaranteed exhaust gas recirculation may eliminate the need for air throttling, thus increasing fuel efficiency and/or leading to a lean burn condition. In addition, by choosing to direct exhaust gas into EGR circuit 116 downstream of particulate filter 134, particulate matter in the recirculated exhaust gas may be reduced or eliminated, which may improve power unit 100 performance, prolong the life of power unit 100, and/or improve the quality of emissions from power unit 100.

The present disclosure may also provide an EGR system and method of recirculating exhaust gas that prolongs the life of mixing valve 148. More specifically, by placing mixing valve 148 within air induction circuit 112 downstream of exhaust cooler 144, the temperature of exhaust gases entering mixing valve 148 may be controlled to minimize or eliminate the degrading effects of high temperatures on mixing valve 148.

It will be apparent to those skilled in the art that various modifications and variations can be made to the disclosed EGR system. Other embodiments will be apparent to those skilled in the art from consideration of the specification and practice of the disclosed EGR system. It is intended that the specification and examples be considered as exemplary only, with a true scope being indicated by the following claims and their equivalents.

What is claimed is:

1. An exhaust treatment system for an engine, comprising:

an air induction circuit configured to direct air into the engine;

an exhaust circuit configured to direct exhaust from the engine, the exhaust circuit including:

a turbine driven by the exhaust;

a particulate filter disposed in series with and located downstream of the turbine; and a catalytic device disposed in series with and located downstream of the particulate filter; and an exhaust gas recirculation circuit configured to selectively redirect at least a portion of the exhaust from between the particulate filter and the catalytic device to the air induction circuit, wherein the catalytic device is configured to create a backpressure within the exhaust circuit sufficient to ensure that, under all normal engine operating conditions above low idle, exhaust can flow into the air induction circuit without throttling of the air directed into the engine.

2. The exhaust treatment system of claim 1, wherein the catalytic device creates a backpressure of between 10-30 kPa at rated engine conditions.

3. The exhaust treatment system of claim 2, wherein the catalytic device creates a backpressure more preferably between 10-15 kPa at rated engine conditions.

4. The exhaust treatment system of claim 1, wherein the catalytic device creates a minimum backpressure of at least 1 kPa at normal engine operating conditions above low idle.

5. The exhaust treatment system of claim 1, further including a mixing valve configured to control the ratio of intake air and exhaust entering the engine.

6. The exhaust treatment system of claim 5, farther including an exhaust cooler located upstream of the mixing valve.

7. The exhaust treatment system of claim 5, further including an intake air passageway configured to direct atmospheric air to a compressor, wherein the mixing valve is disposed at an inlet of the intake air passageway.

8. The exhaust treatment system of claim 1, wherein the catalytic device includes a first catalyst filter and a second catalyst filter disposed in series to generate the backpressure.

9. The exhaust treatment system of claim 1, wherein the catalytic device is a NOx reducer.

10. A method of producing power, comprising:

mixing intake air with fuel;

combusting the mixture to generate power and a flow of exhaust;

utilizing the exhaust to compress the intake air;

removing particulate matter from the exhaust;

catalyzing the exhaust to reduce a constituent of the exhaust; and redirecting the particulate-reduced exhaust to mix with the intake air, wherein the step of catalyzing creates a backpressure within the exhaust sufficient to ensure that, under all normal combustion conditions above low idle, the exhaust can be redirected to mix with the intake air without throttling of the intake air.

11. The method of claim 10, wherein the step of catalyzing includes creating a backpressure of between 10-30 kPa at rated combustion conditions.

12. The method of claim 11, wherein the step of catalyzing includes creating a backpressure more preferably between 10-15 kPa at rated combustion conditions.

13. The method of claim 10, wherein the step of catalyzing includes creating a minimum backpressure of at least 1 kPa under normal combustion conditions above low idle.

14. The method of claim 10, wherein catalyzing includes a first stage of catalyzing and a second stage of catalyzing, each of the first and second stages of catalyzing increasing the backpressure.

15. The method of claim 10, wherein the constituent is an oxide of nitrogen.

16. A combustion engine, comprising:

an engine block at least partially defining a combustion chamber;

an air induction system configured to direct air into the combustion chamber, the air induction system having an intake air passageway communicating atmospheric air with a compressor;

an exhaust system configured to direct exhaust from the combustion chamber, the exhaust system including:

a turbine driven by the exhaust;

a particulate filter disposed in series with and located downstream of the turbine; and at least one NOx reducer disposed in series with and located downstream of the particulate filter;

an exhaust gas recirculation system having an EGR passageway configured to selectively redirect at least a portion of the exhaust from between the particulate filter and the NOx reducer to the air induction system, wherein the NOx reducer is configured to create a backpressure within the exhaust system sufficient to ensure that, under all normal engine operating conditions above low idle, all the exhaust that is redirected to the air induction system of the engine, can flow through the EGR passageway into the air induction system without throttling of the air directed into the engine; and a mixing valve, configured to control the ratio of intake air and exhaust entering the combustion chamber, wherein the mixing valve is disposed within the intake air passageway.

17. The combustion engine of claim 16, wherein the catalytic device creates a backpressure of between 10-30 kPa at rated engine conditions.

18. The combustion engine of claim 17, wherein the catalytic device creates a backpressure more preferably between 10-15 kPa at rated engine conditions.

19. The combustion engine of claim 16, wherein the catalytic device creates a minimum backpressure of at least 1 kPa under normal engine operating conditions above low idle.

20. The combustion engine of claim 16, further including a cooler disposed between the particulate filter and the mixing valve.

* * * * *